US011532414B2

(12) United States Patent
Mitomi et al.

(10) Patent No.: US 11,532,414 B2
(45) Date of Patent: Dec. 20, 2022

(54) POWDER FOR DUST CORE AND DUST CORE

(71) Applicant: DENSO CORPORATION, Kariya (JP)

(72) Inventors: Masataka Mitomi, Kariya (JP); Tomoyasu Watanabe, Kariya (JP)

(73) Assignee: DENSO CORPORATION, Kariya (JP)

( * ) Notice: Subject to any disclaimer, the term of this patent is extended or adjusted under 35 U.S.C. 154(b) by 254 days.

(21) Appl. No.: 16/774,865

(22) Filed: Jan. 28, 2020

(65) Prior Publication Data

US 2020/0168377 A1 May 28, 2020

Related U.S. Application Data

(63) Continuation of application No. PCT/JP2018/026806, filed on Jul. 18, 2018.

(30) Foreign Application Priority Data

Aug. 2, 2017 (JP) ..... JP2017-149937

(51) Int. Cl.

| | |
|---|---|
| ***H01F 1/22*** | (2006.01) |
| ***H01F 27/255*** | (2006.01) |
| ***H01F 41/02*** | (2006.01) |
| ***B22F 1/00*** | (2022.01) |
| ***B22F 3/24*** | (2006.01) |
| ***B22F 3/16*** | (2006.01) |
| ***B22F 1/052*** | (2022.01) |

(52) U.S. Cl.

CPC ..... *H01F 1/22* (2013.01); *B22F 1/052* (2022.01); *H01F 27/255* (2013.01); *H01F 41/0246* (2013.01); *B22F 3/16* (2013.01); *B22F 3/24* (2013.01); *B22F 2003/247* (2013.01); *B22F 2003/248* (2013.01)

(58) Field of Classification Search

CPC ..... C01P 2004/53

See application file for complete search history.

(56) References Cited

U.S. PATENT DOCUMENTS

| | | | |
|---|---|---|---|
| 6,726,740 | B1 | 4/2004 | Draxler et al. |
| 2009/0226751 | A1 | 9/2009 | Mitani et al. |

(Continued)

FOREIGN PATENT DOCUMENTS

| | | | |
|---|---|---|---|
| JP | 2003517195 | A | 5/2003 |
| JP | 2004296606 | A | 10/2004 |
| JP | 200712745 | A | 1/2007 |

(Continued)

OTHER PUBLICATIONS

Machine translation JP-2007012745-A (Year: 2007).*

(Continued)

*Primary Examiner* — Alexandre F Ferre

(74) *Attorney, Agent, or Firm* — Harness, Dickey & Pierce, P.L.C.

(57) ABSTRACT

A powder for dust core used for a dust core includes a plurality of crystal grains, and the powder has at least two maximal values when a number ratio that is a ratio of the number of the crystal grains at each crystal grain diameter to the number of the crystal grains each crystal grain diameter of which has been measured is plotted with respect to each crystal grain diameter of the crystal grains.

5 Claims, 14 Drawing Sheets

(56) References Cited

U.S. PATENT DOCUMENTS

| | | | |
|---|---|---|---|
| 2013/0294129 | A1 | 11/2013 | Inaba |
| 2017/0263356 | A1 | 9/2017 | Kusawake et al. |

FOREIGN PATENT DOCUMENTS

| | | | | | |
|---|---|---|---|---|---|
| JP | 2007012745 | A | * | 1/2007 | |
| JP | 2008063652 | A | | 3/2008 | |
| JP | 2012212855 | A | | 11/2012 | |
| WO | WO-2016043025 | A1 | * | 3/2016 | ..... H01F 1/147 |

OTHER PUBLICATIONS

Machine translation WO-2016043025-A1 (Year: 2016).*
International Search Report issued in PCT/JP2018/026806, dated Sep. 11, 2018; ISA/JP.

* cited by examiner

POWDER FOR DUST CORE AND DUST CORE

CROSS-REFERENCE TO RELATED APPLICATION

This application is a U.S. application under 35 U.S.C. 111(a) and 363 that claims the benefit under 35 U.S.C. 120 from International Application No. PCT/JP2018/026806 filed on Jul. 18, 2018, the entire contents of which are incorporated herein by reference. The present application is also based on Japanese Patent Application No. 2017-149937 filed on Aug. 2, 2017, the entire contents of which are incorporated herein by reference.

BACKGROUND

Technical Field

The present disclosure relates to a dust core and a powder for a dust core and a dust core.

Background Art

Conventionally, a dust core used for a motor, an ignition coil, or the like is known.

As a material used for a dust core, an iron-based powder in which when a crystal grain diameter distribution is obtained, 70% or more of crystal grain diameters are 50 μm or more is known.

SUMMARY

The present disclosure is a powder for a dust core used for a dust core. The powder for the dust core includes a plurality of crystal grains and has at least two maximal values when a number ratio that is a ratio of the number of crystal grains at each crystal grain diameter to the number of crystal grains each crystal grain diameter is plotted with respect to each crystal grain diameter of the crystal grains.

BRIEF DESCRIPTION OF THE DRAWINGS

The above-described objects, other objects, features, and advantages of the present disclosure will become more apparent from the following detailed description with reference to the accompanying drawings. In the accompanying drawings.

DETAILED DESCRIPTION OF THE PREFERRED EMBODIMENTS

Figure 1:
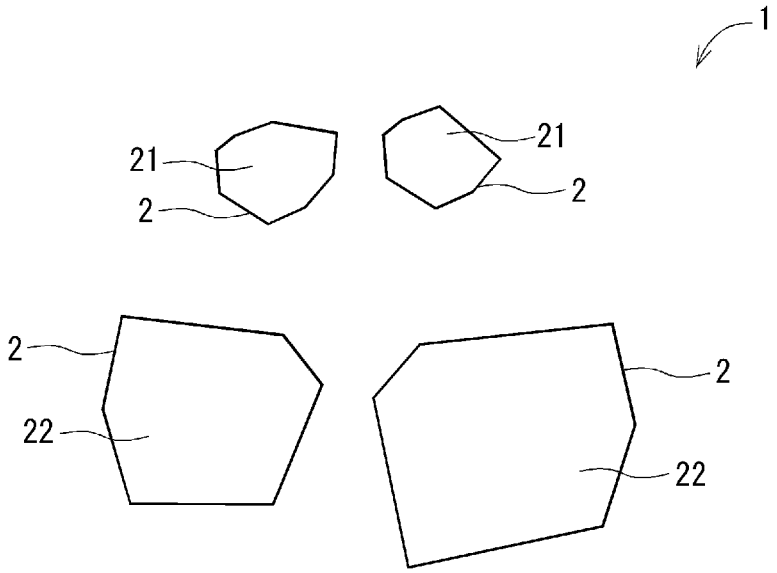
FIG. 1 is a schematic diagram of a powder for dust core of the present embodiment.

Hereinafter, an embodiment of a powder for dust core and a dust core will be described based on the drawings. In the description of a plurality of embodiments, substantially the same configuration will use the same reference signs for description. The present embodiment encompasses a plurality of embodiments. A powder for dust core of the present embodiment is used for manufacturing a dust core. This dust core is used for a core such as a rotor or stator of a motor, a reactor, or an ignition coil.

Generally, an iron loss, which is a loss in the electromagnetic conversion characteristics of a dust core, is represented by the sum of a hysteresis loss corresponding to an area of a magnetic flux density—magnetic field curve and an eddy-current loss, which is a Joule loss of an induction current caused by an electromotive force generated by electromagnetic induction arising from a magnetic field change. The configuration of JP 2008-063652 A reduces the hysteresis loss by increasing the ratio of relatively large crystal grain diameters.

The hysteresis loss is reduced more as the crystal grain diameter is larger. On the other hand, the eddy-current loss is reduced more as a median diameter of powder is smaller. As with the conventional configuration, when the crystal grain diameter is increased, the median diameter becomes large, and the eddy-current loss increases. In the grain diameter design of the powder, it is difficult to achieve both reduction in the hysteresis loss and reduction in the eddy-current loss.

The object of the present disclosure is to provide a powder for dust core and a dust core which achieve both reduction in the hysteresis loss and reduction in the eddy-current loss and achieve a low iron loss.

The present disclosure is a powder for a dust core used for a dust core. The powder for the dust core includes a plurality of crystal grains and has at least two maximal values when a number ratio that is a ratio of the number of crystal grains at each crystal grain diameter to the number of crystal grains each crystal grain diameter of which has been measured is plotted with respect to each crystal grain diameter of the crystal grains.

When a relatively larger maximal value is adjusted, the number ratio of the crystal grains each having a relatively large crystal grain diameter becomes large. For this reason, the hysteresis loss is reduced. In addition, when a relatively smaller maximal value is adjusted, the median diameter of the powder for dust core becomes small. For this reason, the eddy-current loss is reduced. Therefore, it is possible to achieve both reduction in the hysteresis loss and reduction in the eddy-current loss and achieve the low iron loss.

In addition, the present disclosure is a powder for dust core used for a dust core. The powder for the dust core includes a plurality of crystal grains, and a ratio of the number of crystal grains each having a crystal grain diameter of 50 μm or more to the number of measured crystal grains is 5 to 35%.

Further, the present disclosure is provided as a dust core formed of the powder for dust core.

The same effect as that of the powder for dust core is exhibited.

First Embodiment

As shown in FIG. 1, a powder 1 for dust core is a metal powder of a ferromagnetic material or a soft magnetic material, includes a plurality of crystal grains 2, and is an aggregate of crystal grains 2.

Examples of the powder 1 for dust core include pure iron grains, iron-based alloy grains, and amorphous grains. Examples of the iron-based alloy grain include an Fe—Al alloy, an Fe—Si alloy, a Sendust, and a Permalloy. The grain diameter of the crystal grain 2 is defined as a crystal grain diameter D [μm]. The ratio of the number of crystal grains 2 at each crystal grain diameter D to the number of crystal grains 2 each grain diameter of which has been measured is defined as a number ratio Rv [%].

The crystal grains 2 have first grains 21 and second grains 22. The first grains 21 and the second grains 22 are prepared by an atomization method, mechanical crushing, a reduction method, or the like. Examples of the atomization method include a water atomization method, a gas atomization method, and a gas water atomization method. Each of the first grains 21 and the second grains 22 is a powder the grain diameter of which is adjusted by using a sieve.

The first grains 21 can pass through a sieve having a mesh size of 90 μm or more and 180 μm or less. Note that, the mesh size is one of criteria representing size or density of a mesh of the sieve and indicates a vertical size or a horizontal size in a space per mesh.

The second grains 22 can pass through a sieve having a mesh size of 212 μm or more and 250 μm or less. The ratio of a weight of the second grains 22 to a total weight of the powder 1 for dust core is referred to as a second grain weight ratio W2. The first grains 21 and the second grains 22 are mixed, and the powder 1 for dust core is prepared so that the second grain weight ratio W2 is 20% or more and 50% or less.

The prepared powder 1 for dust core is filled into a mold. The filled powder 1 for dust core is press-molded so that the density is a predetermined value. The predetermined value is set arbitrarily and set so that an iron loss, a hysteresis loss, and an eddy-current loss can be easily measured. The press-molded powder 1 for dust core is annealed in a vacuum at a predetermined temperature for a predetermined time to remove strain. The crystal grain diameter D of the annealed powder 1 for dust core is measured by a metallograph. After measurement of the crystal grain diameter D, the iron loss, the hysteresis loss and the eddy-current loss of the powder 1 for dust core are measured.

Figure 2:
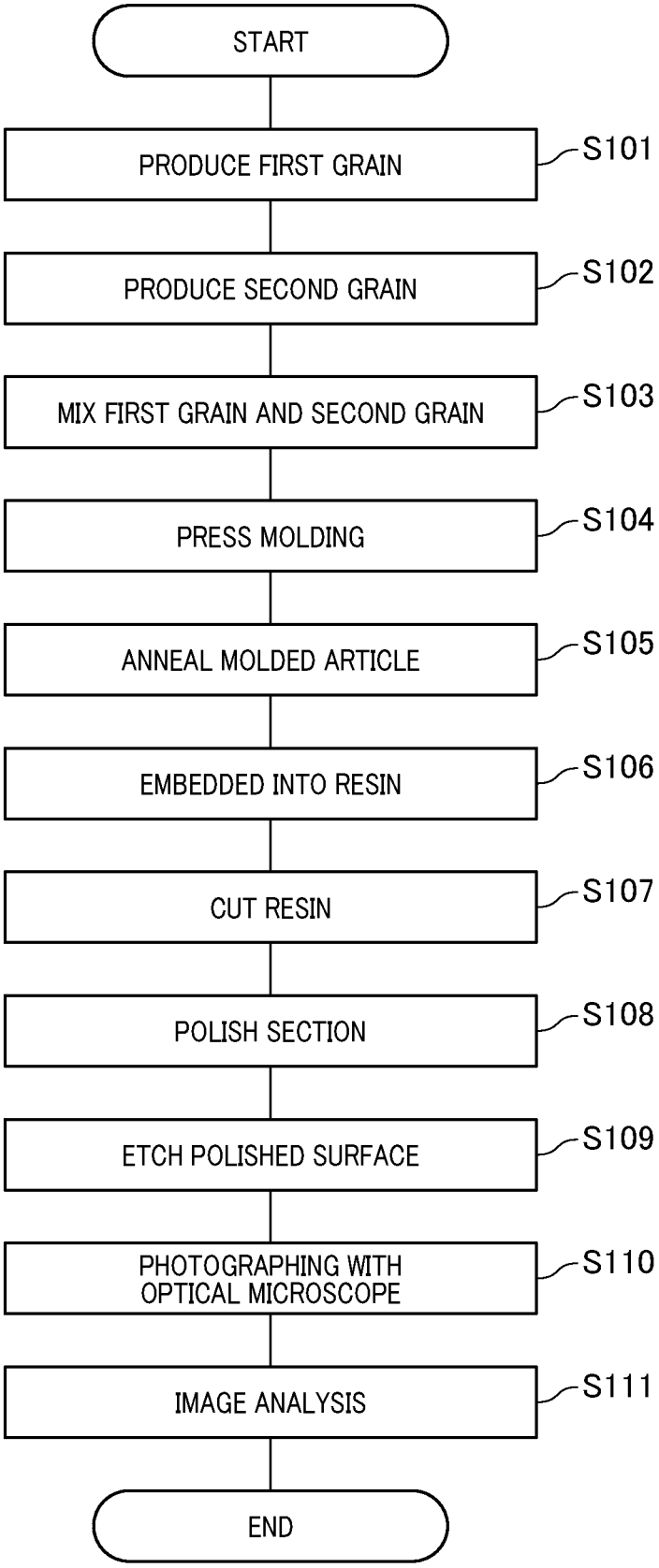
FIG. 2 is a flowchart for explaining a measurement of a crystal grain diameter of a powder for dust core of a first embodiment.

With reference to a flowchart of FIG. 2, the measurement of crystal grain diameter D will be described. In the flowchart, S means a step.

In step 101, the first grains 21 are produced using a sieve having a mesh size of 90 μm or more and 180 μm or less.

In step 102, the second grains 22 are produced using a sieve having a mesh size of 212 μm or more and 250 μm or less.

In step 103, the first grains 21 and the second grains 22 are mixed, and the powder 1 for dust core is prepared so that the second grain weight ratio W2 is 20% or more and 50% or less.

In step 104, the adjusted powder 1 for dust core is filled into a mold and press-molded.

In step 105, the press-molded powder 1 for dust core is annealed.

In step 106, the powder 1 for dust core is embedded into resin.

In step 107, the resin into which the powder 1 for dust core is embedded is cut so as to expose a section of the powder 1 for dust core.

In step 108, the exposed section of the powder 1 for dust core is mirror-polished.

In step 109, the mirror-polished section is etched.

In step 110, the etched section is observed with a magnification of 100 to 400 by using an optical microscope. Further, by using the optical microscope, a plurality of points of the etched section are photographed. In the first embodiment, 5 to 10 points are photographed. In the plurality of photographed images, 100 or more crystal grains 2 of the powder 1 for dust core embedded into the resin are observed.

In step 111, from the photographed photo, a target crystal grain 2 is image-analyzed. In the image analysis, an image processing program is used.

Figure 3:
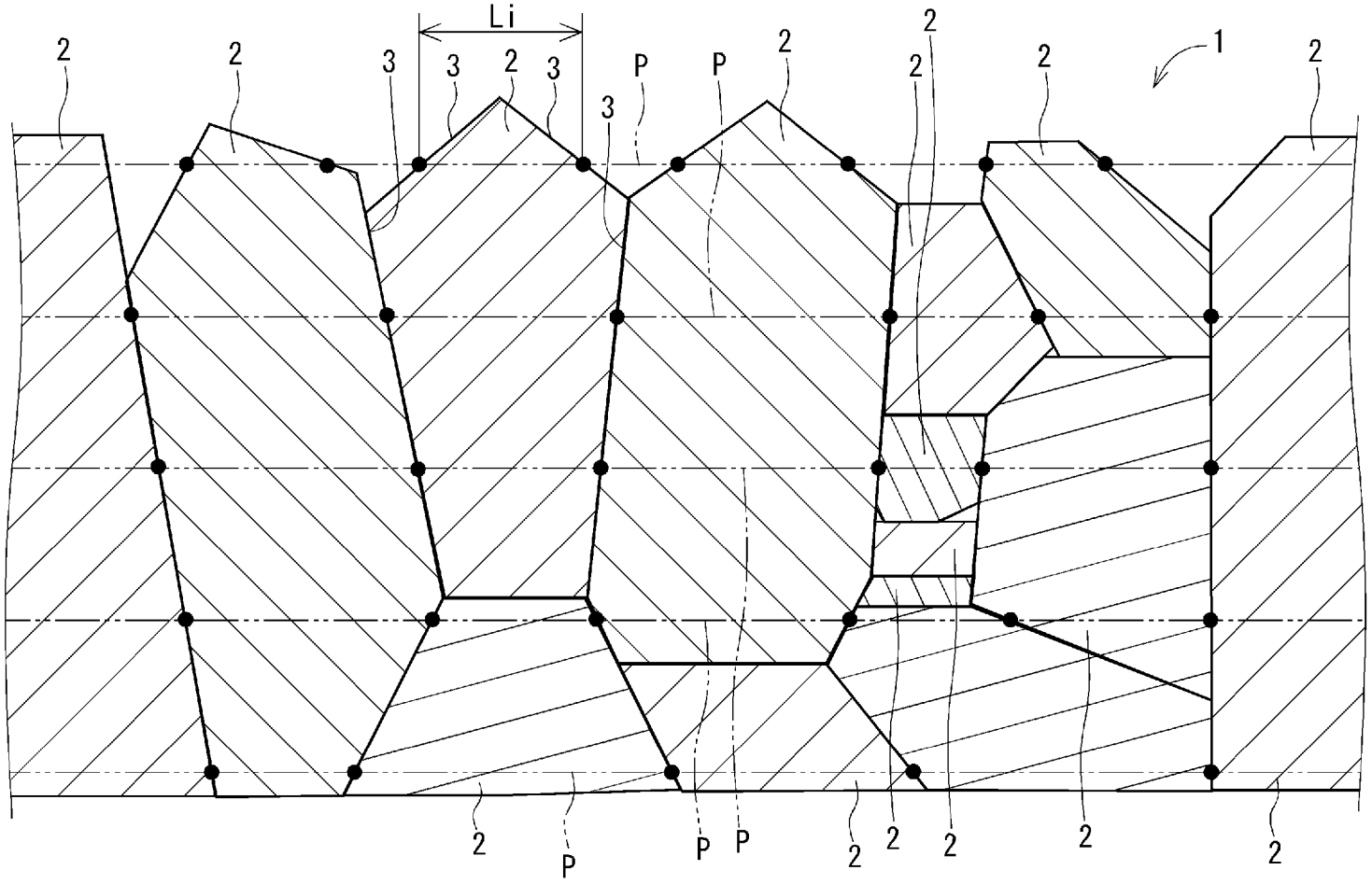
FIG. 3 is a schematic diagram for explaining image analysis of a crystal grain of the powder for dust core of the first embodiment.

As shown in FIG. 3, in the image analysis, a plurality of parallel lines P are drawn at a predetermined interval for one image. In the figure, to clearly show the crystal grain 2, the crystal grain 2 is shown exaggerated. In addition, in the figure, five parallel lines P are drawn extending in the horizontal direction of the sheet. The distance between intersection points between the grain boundary 3 which is the boundary face or the end face of the crystal grains 2, and the parallel line P is referred to as an intersection distance Li.

The intersection distance Li is measured according to the number of intersection points between the grain boundaries 3 of one crystal grain 2 and the parallel line P. The average value of the measured intersection distances Li is set as the crystal grain diameter D. Note that, when the grain boundary 3 and the parallel line P do not intersect in one crystal grain 2, the crystal grain diameter D of the crystal grain 2 is excluded from measurement. In the figure, to clearly show an intersection point, the intersection point is shown black. The number ratio Rv is calculated from the measured crystal grain diameter D. The number ratio Rv is plotted with respect to each crystal grain diameter D, and a grain diameter distribution curve C, which is a curve obtained by connecting the plotted points, is drawn.

Figure 4:
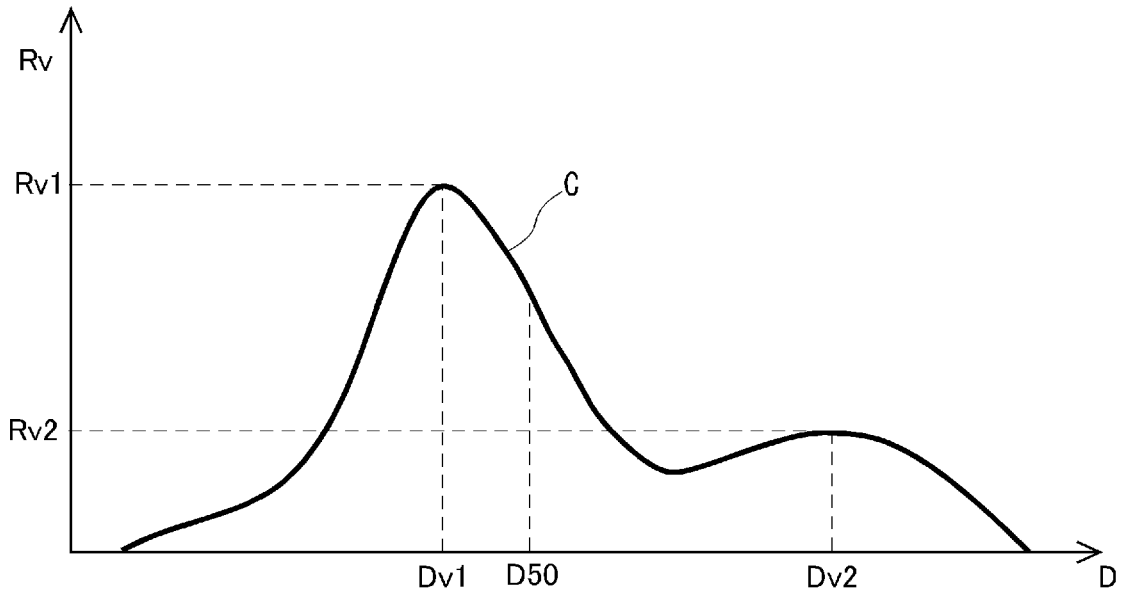
FIG. 4 is a diagram showing a grain diameter distribution curve of the powder for dust core of the first embodiment.

As shown in FIG. 4, the powder 1 for dust core has at least two maximal values on the grain diameter distribution curve C. In the figure, with an axis extending in the horizontal direction of the sheet as an axis of the crystal grain diameter D, and an axis extending in the vertical direction of the sheet as an axis of the number ratio Rv, the grain diameter distribution curve C is drawn. In the first embodiment, two maximal values are provided. That is, the grain diameter distribution curve C has two peaks. The maximal value is, on the grain diameter distribution curve C, a point at which the inclination of a tangent is zero, and is a turning point at which a sign of the inclination of a tangent changes from plus to minus along with increase of the crystal grain diameter D. Note that, it is assumed herein that ☐ero ☐ includes a reasonable error range.

One maximal value is referred to as a first maximal value Rv1 [%]. The other maximal value is referred to as a second maximal value Rv2 [%]. The crystal grain diameter D corresponding to the first maximal value Rv1 is referred to as a first grain diameter Dv1 [μm]. The crystal grain diameter D corresponding to the second maximal value Rv2 is referred to as a second grain diameter Dv2 [μm]. The second grain diameter Dv2 is larger than the first grain diameter Dv1.

The powder 1 for dust core has the second grain diameter Dv2 of 50 μm or more and is adjusted so that the second maximal value Rv2 is 5 to 35%. The powder 1 for dust core is adjusted so that the median diameter D50 [μm] is 30 μm or less. Note that the median diameter D50 is a crystal grain diameter D when the number ratio Rv is 50%.

A dust core using the powder 1 for dust core is formed, and the loss in a motor using the dust core is measured based on JIS C 4034-2-1. The hysteresis loss is proportional to frequency, and the eddy-current loss is proportional to the square of frequency. For this reason, from the relation between the iron loss at each frequency and the frequency, the iron loss can be separated into a hysteresis loss and an eddy-current loss. The conventional dust core using a powder for dust core in which 70% or more of crystal grain diameters are 50 μm or more is used as a comparative example. The iron loss of a dust core using the powder 1 for dust core of the present embodiment is compared with the iron loss of the comparative example.

As the crystal grain diameter of the powder for dust core increases, the boundary face of the grain boundary becomes larger. At this time, a magnetic domain representing a region in which spins are directed in the same direction and a domain wall which is a boundary with the magnetic domain easily move, and the hysteresis loss is reduced. On the other hand, as the crystal grain diameter of the powder for dust core is larger, an area in the grain increases, and thus the eddy-current in the grain is larger. For this reason, the eddy-current loss increases. With the conventional configuration, since the crystal grain diameter of the powder for dust core is large, the eddy-current loss increases. Conventionally, in the powder grain diameter design, it has been difficult to achieve both reduction in the hysteresis loss and reduction in the eddy-current loss. Therefore, in the powder 1 for dust core of the present embodiment, both reduction in the hysteresis loss and reduction in the eddy-current loss are achieved, and low iron loss is achieved.

Figure 5:
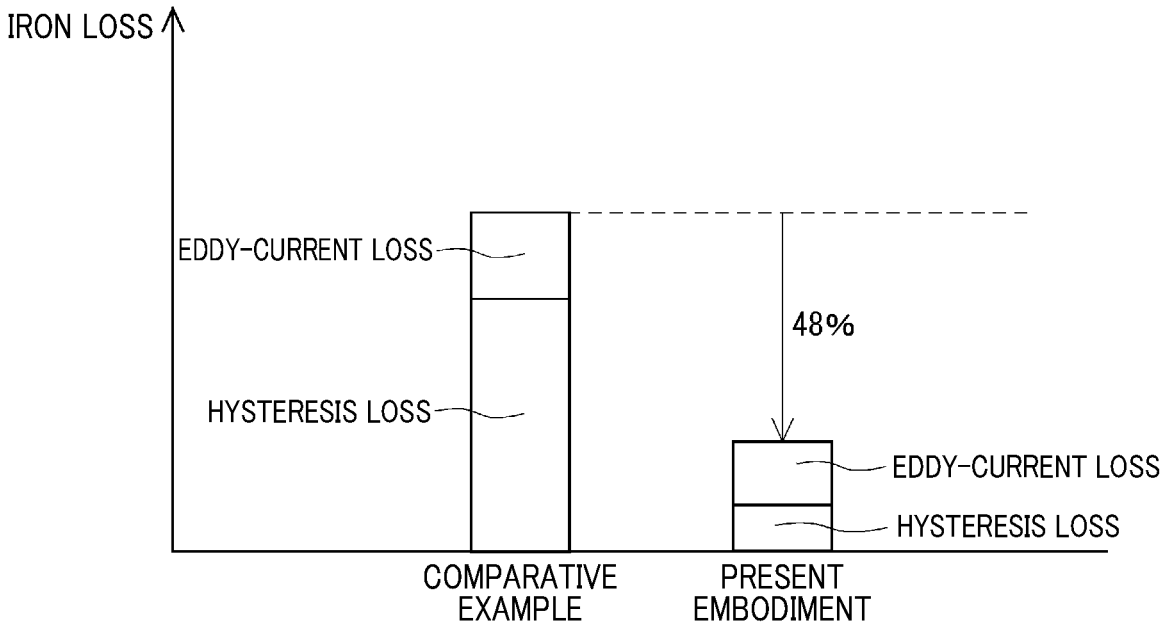
FIG. 5 is a diagram showing an iron loss of the powder for dust core of the first embodiment.

(1) As shown in FIG. 5, in the powder 1 for dust core, the iron loss is reduced by approximately 48% compared with the comparative example. Of these, the hysteresis loss is reduced by approximately 43%, and the eddy-current loss is reduced by 5%.

The powder 1 for dust core has, on the grain diameter distribution curve C, at least two maximal values. By adjusting the second grain diameter Dv2 and the second maximal value Rv2, it is possible to increase the number ratio Rv of the relatively larger crystal grain diameter D. This makes the boundary face of the grain boundary 3 larger and makes the domain wall easily move. For this reason, the hysteresis loss is reduced. In addition, the median diameter D50 can be made small by adjustment of the first grain diameter Dv1 and the first maximal value Rv1. This reduces the eddy-current loss. Therefore, it is possible to achieve both reduction in the hysteresis loss and reduction in the eddy-current loss and to achieve low iron loss.

(2) The hysteresis loss of the dust core using the powder 1 for dust core is measured with the second maximal value Rv2 constant and the second grain diameter Dv2 changed. In the figure, the hysteresis loss is plotted with respect to the reciprocal of the second grain diameter Dv2.

Figure 6:
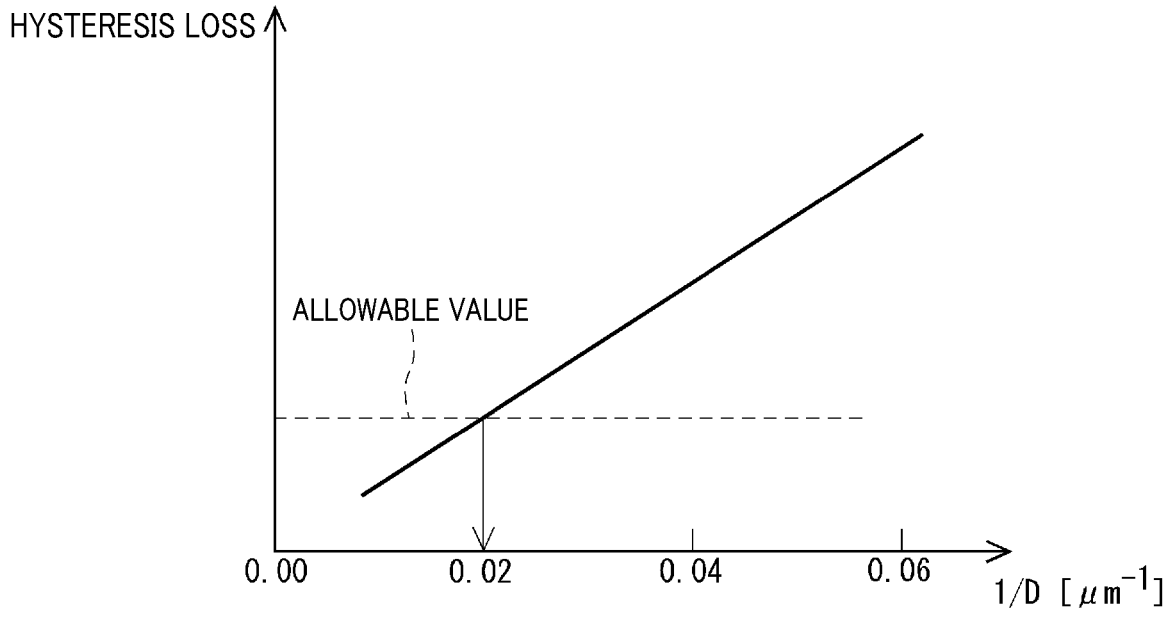
FIG. 6 is a correlation diagram showing a reciprocal of a crystal grain diameter and a hysteresis loss of the powder for dust core of the first embodiment.

As shown in FIG. 6, as the reciprocal of the second grain diameter Dv2 becomes smaller, that is, as the second grain diameter Dv2 becomes larger, the hysteresis loss is reduced. According to the investigation based on characteristics of the powder 1 for dust core used in the present embodiment, the hysteresis loss is an allowable value or less when the reciprocal of the second grain diameter Dv2 is 0.02 or less, that is, the second grain diameter Dv2 is 50 μm or more.

(3) The iron loss of the dust core using the powder 1 for dust core is measured with the second grain diameter Dv2 constant and the second maximal value Rv2 changed. In the figure, the iron loss is plotted with respect to each second maximal value Rv2.

Figure 7:
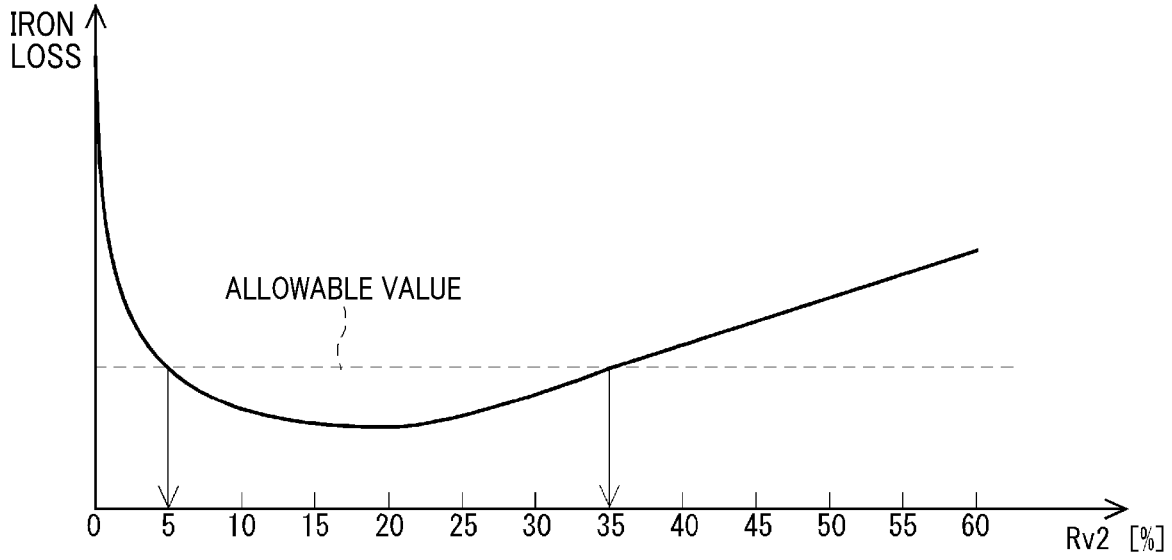
FIG. 7 is a correlation diagram showing a second maximal value and an iron loss of the powder for dust core of the first embodiment.

As shown in FIG. 7, as the second maximal value Rv2 is larger, that is, as the number ratio Rv of the relatively larger crystal grain diameter D is larger, the hysteresis loss is reduced. For this reason, the iron loss is reduced. The iron loss is minimum when the second maximal value Rv2 is 20%. Further, when the second maximal value Rv2 becomes larger, the median diameter D50 becomes larger, and the eddy-current loss increases. For this reason, the iron loss increases. According to the investigation based on characteristics of the powder 1 for dust core used in the present embodiment, the iron loss is an allowable value or less when the second maximal value Rv2 is 5 to 35%.

(4) The eddy-current loss of the dust core using the powder 1 for dust core is measured with the second grain diameter Dv2 and the second maximal value Rv2 constant and the median diameter D50 of the powder 1 for dust core changed.

Figure 8:
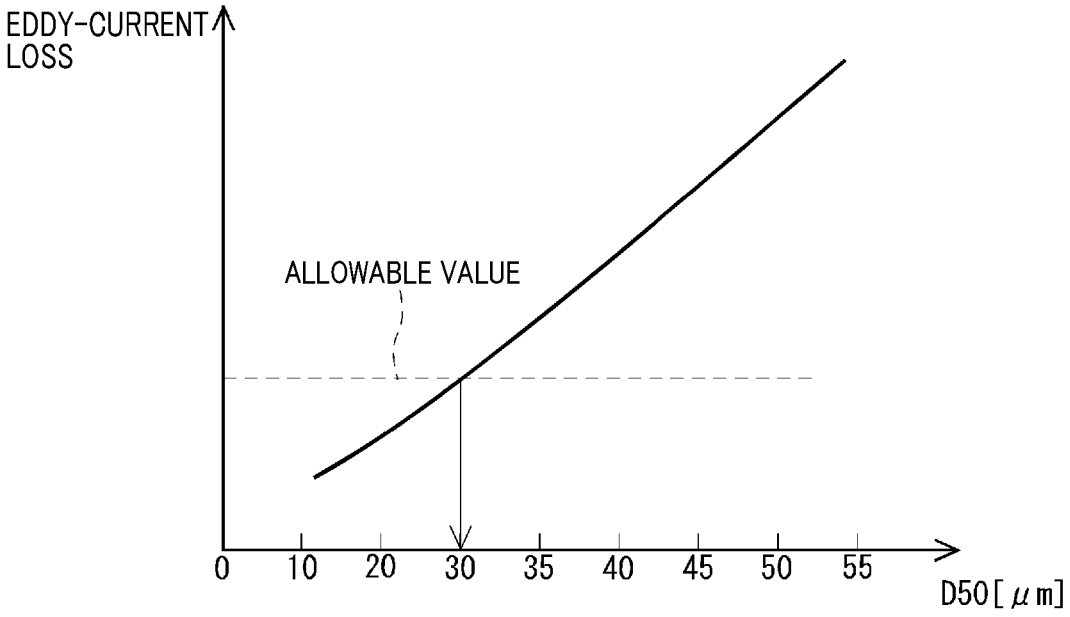
FIG. 8 is a correlation diagram showing a median diameter and an eddy-current loss of the powder for dust core of the first embodiment.

As shown in FIG. 8, as the median diameter D50 of the powder 1 for dust core becomes smaller, the eddy-current loss is reduced. According to the investigation based on characteristics of the powder 1 for dust core used in the present embodiment, the eddy-current loss is an allowable value or less when the median diameter D50 of the powder 1 for dust core is 30 μm or less.

(5) The first grains 21 and the second grains 22 are mixed so that the second grain weight ratio W2 is 20% or more and 50% or less. This makes it easy to adjust the second grain diameter Dv2 and the second maximal value Rv2 on the grain diameter distribution curve C of the powder 1 for dust core.

Second Embodiment

The second embodiment is the same as the first embodiment except that measurement of the crystal grain diameter is different. The grain diameter measurement may produce variable results depending on the measurement method. In the second embodiment, the powder 1 for dust core is measured using light. Each crystal grain diameter D of the powder 1 for dust core is measured based on JIS Z 8825.

Figure 9:
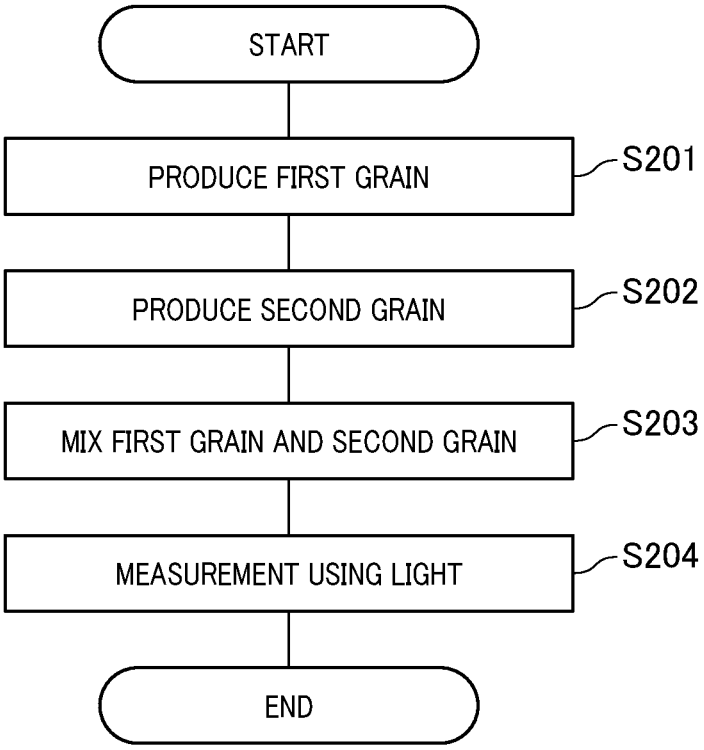
FIG. 9 is a flowchart for explaining a measurement of a crystal grain diameter of a powder for dust core of a second embodiment.

With reference to flowchart of FIG. 9, measurement of the crystal grain diameter D will be described. Steps 201 to 203 are the same as steps 101 to 103 in the first embodiment.

In step 204, the crystal grain diameter D of the crystal grain 2 in the powder 1 for dust core is measured by a diffraction method using light such as a laser. When light passes through the crystal grain 2, the light is scattered. As an angle of the scattered light is larger, the crystal grain diameter D is smaller. The crystal grain diameter D is measured by measurement and analysis of the angle of the scattered light. In the second embodiment, the grain diameter distribution curve C is drawn by use of the crystal grain diameter D measured by light.

Also, in the second embodiment, an effect similar to (1) of the first embodiment is exhibited.

(6) The hysteresis loss of the dust core using the powder 1 for dust core of the second embodiment is measured with the second maximal value Rv2 constant and the second grain diameter Dv2 changed.

Figure 10:
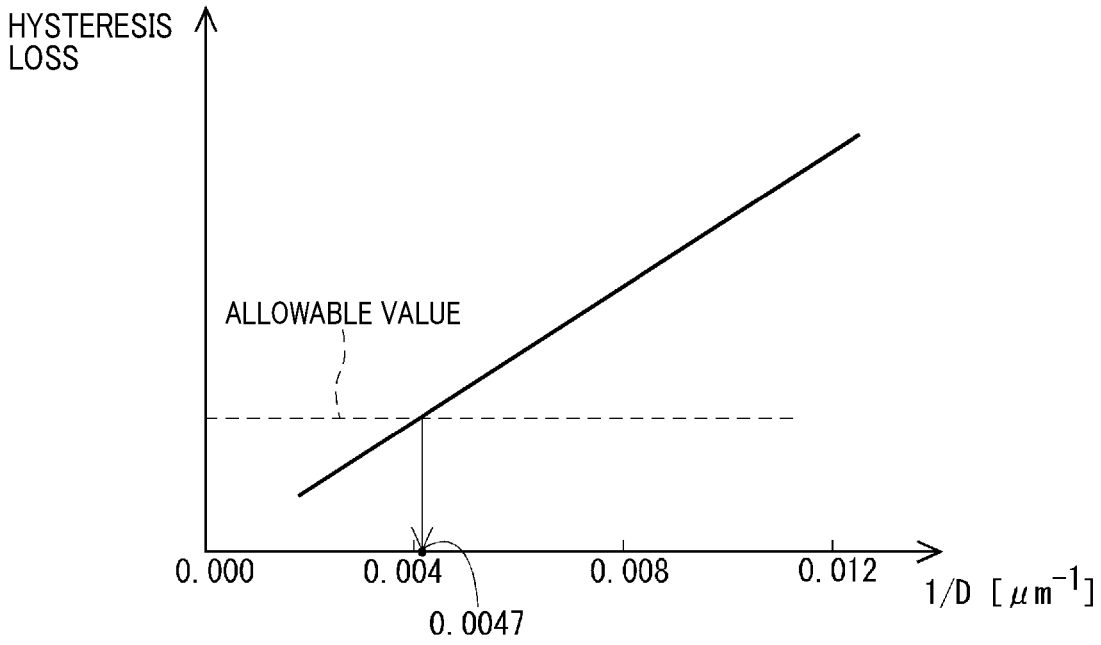
FIG. 10 is a correlation diagram showing a reciprocal of a crystal grain diameter and a hysteresis loss of the powder for dust core of the second embodiment.

As shown in FIG. 10, as the reciprocal of the second grain diameter Dv2 becomes smaller, that is, as the second grain diameter Dv2 becomes larger, the hysteresis loss is reduced. According to the investigation based on characteristics of the powder 1 for dust core used in the present embodiment, the hysteresis loss is an allowable value or less when the reciprocal of the second grain diameter Dv2 is 0.0047 or less, that is, the second grain diameter Dv2 is 212 μm or more. In addition, also in the second embodiment, when the second maximal value Rv2 is 5 to 35%, the iron loss is an allowable value or less.

(7) The eddy-current loss of the dust core using the powder 1 for dust core is measured with the second grain diameter Dv2 and the second maximal value Rv2 constant and the median diameter D50 of the powder 1 for dust core of the second embodiment changed.

Figure 11:
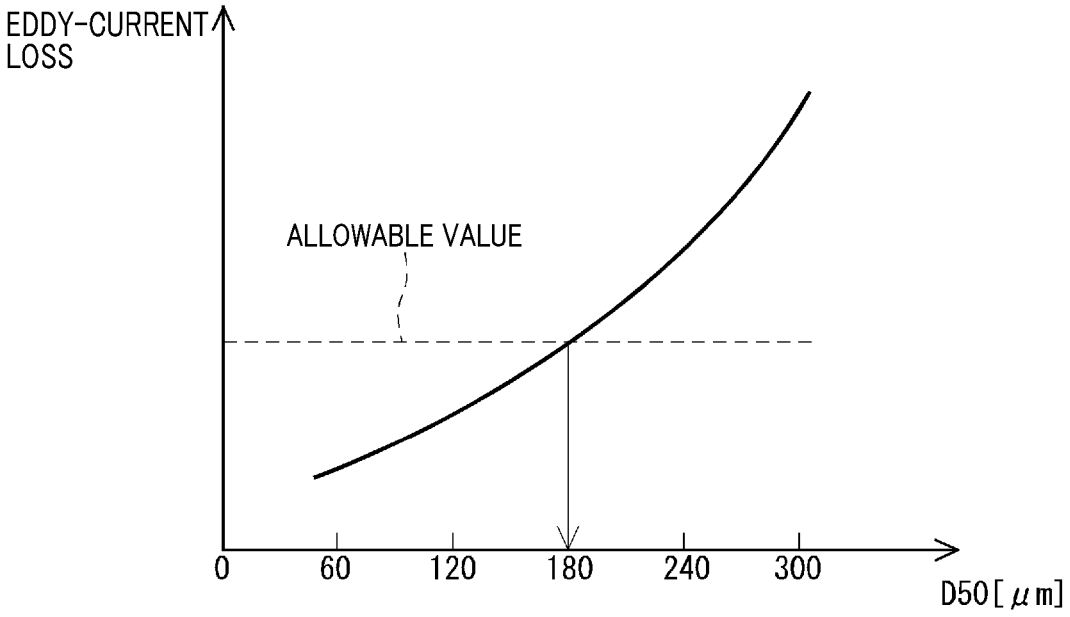
FIG. 11 is a correlation diagram showing a reciprocal of a crystal grain diameter and a hysteresis loss of the powder for dust core of the second embodiment.

As shown in FIG. 11, as the median diameter D50 of the powder 1 for dust core becomes smaller, the eddy-current loss is reduced. According to the investigation based on characteristics of the powder 1 for dust core used in the present embodiment, the eddy-current loss is an allowable value or less when the median diameter D50 of the powder 1 for dust core is 180 μm or less.

Third Embodiment

The third embodiment is the same as the first embodiment except that the grain diameter distribution curve of the powder for dust core is different.

Figure 12:
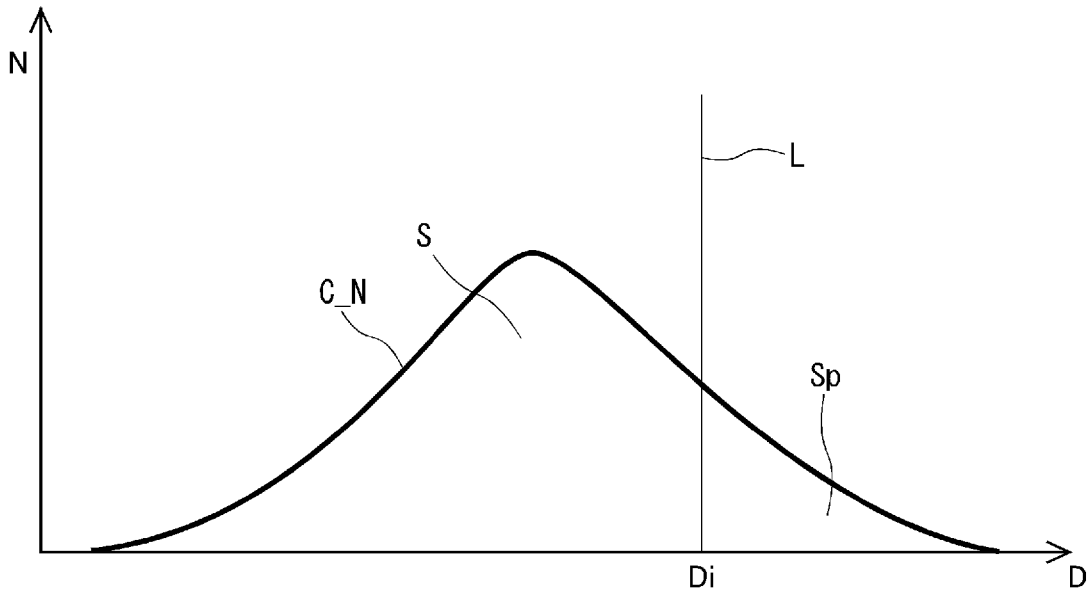
FIG. 12 is a diagram indicating a number distribution curve of a powder for dust core of a third embodiment.

As shown in FIG. 12, in the powder 1 for dust core of the third embodiment, a ratio of the number of crystal grains 2 each having the crystal grain diameter D of 50 μm or more to the number of crystal grains 2 each grain diameter of which has been measured is adjusted to 5 to 35%. In the figure, with an axis extending in the horizontal direction of the sheet as an axis of the crystal grain diameter D, and an axis extending in the vertical direction of the sheet as an axis of the number N of the crystal grains 2, a number distribution curve C_N is produced. In addition, in the figure, a total area S which is an area partitioned by the axis of the crystal grain diameter D and the number distribution curve C_N corresponds to the total number of the crystal grains 2.

A line that intersects with the axis of the crystal grain diameter D and the number distribution curve C_N and is parallel to the axis of the number N is referred to as a partition line L. A value of an intersection point between the partition line L and the axis of the crystal grain diameter D is referred to as an intersection point value Di [μm]. An area partitioned by the partition line L, the axis of the crystal grain diameter D, and the number distribution curve C_N is referred to as a partial area Sp. The partial area Sp corresponds to the number of the crystal grains 2 each crystal grain diameter D of which is the intersection point value Di or more. The powder 1 for dust core of the third embodiment is adjusted so that the intersection point value Di is 50 μm or more, and a ratio Sp/S [%] of the partial area Sp to the total area S is 5 to 35%.

Also, in the third embodiment, an effect similar to (1) of the first embodiment is exhibited.

(8) The hysteresis loss of the dust core using the powder 1 for dust core of the third embodiment is measured with the partial area Sp constant and the intersection point value Di changed. In the figure, the hysteresis loss is plotted with respect to the reciprocal of the intersection point value Di.

Figure 13:
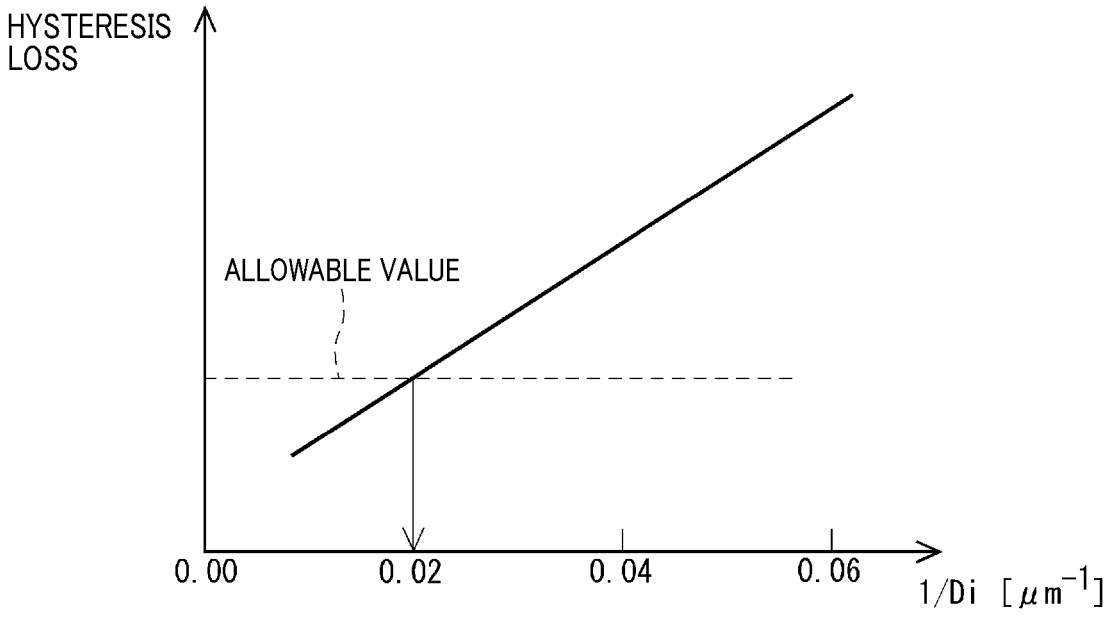
FIG. 13 is a correlation diagram showing a reciprocal of a crystal grain diameter and a hysteresis loss of the powder for dust core of the third embodiment.

As shown in FIG. 13, as the reciprocal of the intersection point value Di becomes smaller, that is, as the intersection point value Di becomes larger, the hysteresis loss is reduced. According to the investigation based on characteristics of the powder 1 for dust core used in the present embodiment, the hysteresis loss is an allowable value or less when the reciprocal of the intersection point value Di is 0.02 or less, that is, the intersection point value Di is 50 μm or more.

(9) The hysteresis loss of the dust core using the powder 1 for dust core of the third embodiment is measured with the intersection point value Di constant in a range of 50 μm, or more and the ratio Sp/S changed. In the figure, the iron loss is plotted with respect to each ratio Sp/S.

Figure 14:
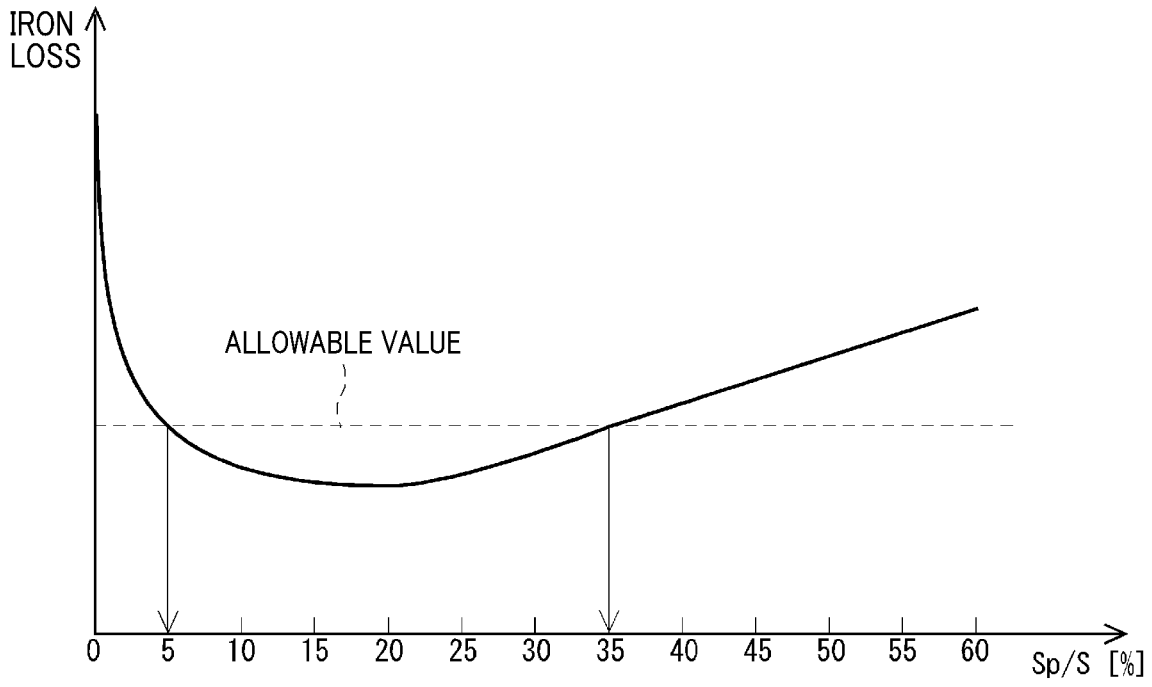
FIG. 14 is a correlation diagram showing a crystal grain and an iron loss of the powder for dust core of the third embodiment.

As shown in FIG. 14, as the ratio Sp/S becomes larger, the number ratio Rv of the relatively larger crystal grain diameter D becomes larger. This reduces the hysteresis loss. For this reason, the iron loss is reduced. Further, when the ratio Sp/S becomes larger, the median diameter D50 becomes larger, and the eddy-current loss increases. For this reason, the iron loss increases. According to the investigation based on characteristics of the powder 1 for dust core used in the present embodiment, the iron loss is an allowable value or less when the ratio Sp/S is 5 to 35%.

Other Embodiments (i) The crystal grain diameter D may be measured by image analysis as described below. With the image analysis, a gravity point of a section of the crystal grain is obtained. A line is drawn on the section of the crystal grain 2 so as to pass the gravity point. The intersection distance Li between the line and an outer edge of the section of the crystal grain 2 is measured. This is measured in increments of 2° for 180 points, and the average value of the measurement results is used as the crystal grain diameter D.

The number of crystal grains 2 for measuring the crystal grain diameter D is at least 50. The larger the number of crystal grains 2 for measuring the crystal grain diameter D, the better. The number of crystal grains 2 for measuring the crystal grain diameter D may be 60 or more, or 70 or more. In the measurement of the crystal grain diameter D, in consideration of the grain diameter distribution of the powder 1 for dust core, the crystal grain 2 is selected so as not to generate great variations.

(ii) The method for measuring the crystal grain diameter D of the powder for dust core may be a centrifugal sedimentation method or an electrical sensing zone method.

(iii) An insulating film may be formed on the powder for dust core by using ferrite or the like. By formation of the insulating film on the powder for dust core, the eddy-current loss is more easily reduced.

(iv) The number of maximal values is not limited to two but only need to be at least two. The larger the number of maximal values, the more easily both reduction in the hysteresis loss and reduction in the eddy-current loss can be achieved.

The present disclosure is not limited to the embodiments described above but can be implemented in various forms in a range not deviating from the gist thereof.

The present disclosure is described according to working examples, but it should be understood that the present disclosure is not limited to the embodiments and structures. The present disclosure also includes various variations and modifications within an equivalent range. In addition, various combinations and forms, and further other combinations and forms including only one element, more than that or less than that in addition to the various combinations and forms are also included in a category and concept of the present disclosure.

What is claimed is:

1. A powder for dust core that is used for a dust core and is formed by mixing powders having two kinds of grain diameters, comprising a plurality of crystal grains, wherein the plurality of crystal grains includes first grains that can pass through a sieve having a mesh size of 90 μm or more and 180 μm or less; and second grains that can pass through a sieve having a mesh size of 212 μm or more and 250 μm or less, wherein a ratio of a weight of the second grains to a weight of the powder for dust core is 20% or more and 50% or less, wherein in a plot of each crystal grain diameter of the crystal grains and a number ratio that is a ratio of the number of the crystal grains at each crystal grain diameter to the number of the crystal grains each crystal grain diameter of which has been measured, on a diameter distribution curve formed by plotting the number ratio and the crystal grain diameter of the crystal grains measured using a section of the powder for the dust core, a median diameter of the crystal grains in the powder for dust core measured using a section of the powder for dust core is 30 μm or less, the powder has two maximal values of the number ratio; and when one maximal value is referred to as a first maximal value, and the other maximal value is referred to as a second maximal value, a crystal grain diameter corresponding to the first maximal value is smaller than a crystal grain diameter corresponding to the second maximal value, and the crystal grain diameter corresponding to the second maximal value is 50 μm or more, and the second maximal value is 5 to 35%.

2. A dust core formed of the powder for dust core according to claim 1.

3. A powder for dust core that is used for a dust core and is formed by mixing powders having two kinds of grain diameters, comprising a plurality of crystal grains, wherein in a plot of each crystal grain diameter of the crystal grains and a number ratio that is a ratio of the number of the crystal grains at each crystal grain diameter to the number of the crystal grains each crystal grain diameter of which has been measured, on a diameter distribution curve formed by plotting the number ratio and each crystal grain diameter of the crystal grains measured using light, the powder has two maximal values of the number ratio; and when one maximal value is referred to as a first maximal value, and the other maximal value is referred to as a second maximal value, a crystal grain diameter corresponding to the first maximal value is smaller than a crystal grain diameter corresponding to the second maximal value, and the crystal grain diameter corresponding to the second maximal value is 212 μm or more, and the second maximal value is 5 to 35%.

4. The powder for dust core according to claim 3, wherein a median diameter of the crystal grains in the powder for dust core measured using light is 180 μm or less.

5. A powder for dust core that is used for a dust core and is formed by mixing powders, comprising a plurality of crystal grains, wherein in a plot of each crystal grain diameter of the crystal grains and a number ratio that is a ratio of the number of the crystal grains at each crystal grain diameter to the number of the crystal grains each crystal grain diameter of which has been measured, a first area which is defined by a first line, a second line, and a diameter distribution curve, the first line corresponding to the number of the crystal grains, the second line being orthogonal to the first line and corresponding to the diameter of the crystal grains, and the diameter distribution curve being formed by plotting the number ratio and the crystal grain diameter of the crystal grains measured, in the first area, a second area is defined by the crystal grains having a diameter of 50 μm or more, and each crystal grain diameter being defined such that a ratio of the second area to the first area is 5 to 35%.

* * * * *